US009898949B2

(12) United States Patent
Huang et al.

(10) Patent No.: US 9,898,949 B2
(45) Date of Patent: Feb. 20, 2018

(54) ELECTRONIC DEVICE FOR ADJUSTING BRIGHTNESS OF DISPLAY SCREEN OF THE ELECTRONIC DEVICE AND METHOD USING THE SAME

(71) Applicant: Chiun Mai Communication Systems, Inc., New Taipei (TW)

(72) Inventors: Hong-Wei Huang, New Taipei (TW); Chun-Yi Lee, New Taipei (TW); Bu-Da Chiou, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 154 days.

(21) Appl. No.: 14/808,631

(22) Filed: Jul. 24, 2015

(65) Prior Publication Data

US 2016/0117996 A1 Apr. 28, 2016

(30) Foreign Application Priority Data

Oct. 27, 2014 (CN) ..... 2014 1 0583857

(51) Int. Cl.
*G09G 5/00* (2006.01)
*G09G 3/20* (2006.01)

(52) U.S. Cl.
CPC ..... *G09G 3/20* (2013.01); *G09G 2320/0626* (2013.01); *G09G 2360/144* (2013.01); *G09G 2360/145* (2013.01)

(58) Field of Classification Search
CPC ..... G09G 2360/144; G09G 2320/0626; G09G 3/3406; H04N 5/58
See application file for complete search history.

(56) References Cited

U.S. PATENT DOCUMENTS 5,760,760 A * 6/1998 Helms ..... G09G 3/36 345/102
2006/0256067 A1* 11/2006 Montero ..... G09G 3/3406 345/102
2007/0146356 A1* 6/2007 Ladouceur ..... G09G 3/36 345/207
2008/0165116 A1* 7/2008 Herz ..... G09G 3/3406 345/102
2010/0141672 A1* 6/2010 Kang ..... G09G 3/342 345/589
2013/0076712 A1* 3/2013 Zheng ..... G01J 1/32 345/207

(Continued)

FOREIGN PATENT DOCUMENTS

CN 101574016 A 11/2009
CN 102968979 A 3/2013
TW 201351389 A 12/2013

*Primary Examiner* — Yuzhen Shen
(74) *Attorney, Agent, or Firm* — ScienBiziP, P.C.

(57) ABSTRACT

In a method for adjusting brightness of a display screen of an electronic device, a current brightness value of the display screen and a current illumination value of ambient lights are acquired, and then are processed by denoising and normalizing. The current brightness value is adjusted to meet user preferences by self-learning according to the current illumination value and a brightness/illumination relationship table which stores a relationship between brightness values of the display screen and illumination values of ambient lights determined according to the user preferences.

15 Claims, 3 Drawing Sheets

(56) References Cited

U.S. PATENT DOCUMENTS

| | | | | |
|---|---|---|---|---|
| 2013/0328842 | A1* | 12/2013 | Barnhoefer | G09G 3/3406 345/207 |
| 2015/0097819 | A1* | 4/2015 | Yang | G09G 3/3406 345/207 |
| 2016/0035285 | A1* | 2/2016 | Jung | G09G 3/2092 345/207 |
| 2016/0098973 | A1* | 4/2016 | Yang | G09G 3/3406 345/207 |

* cited by examiner

ELECTRONIC DEVICE FOR ADJUSTING BRIGHTNESS OF DISPLAY SCREEN OF THE ELECTRONIC DEVICE AND METHOD USING THE SAME

CROSS-REFERENCE TO RELATED APPLICATIONS

This application claims priority to Chinese Patent Application No. 201410583857.0 filed on Oct. 27, 2014, the contents of which are incorporated by reference herein.

FIELD

The subject matter herein generally relates to a method of adjusting brightness of a display device. More particularly, the present disclosure relates to a method of self learning to adjust brightness of a display screen.

BACKGROUND

Electronic devices increasingly include display screens as part of user interfaces. Display screens may be employed in a wide array of devices, including desktop computer systems, notebook computers, and handheld computing devices, as well as various consumer products, such as cellular phones and portable media players. Electronic devices also may include backlights that illuminate the display screens. Ambient light may reflect off the surface of display screens and may reduce the display contrast, thereby making it difficult to view the display screens in high ambient light conditions. Accordingly, as ambient light conditions change, the brightness of a backlight also may be changed to provide sufficient contrast between the ambient light and the backlight.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
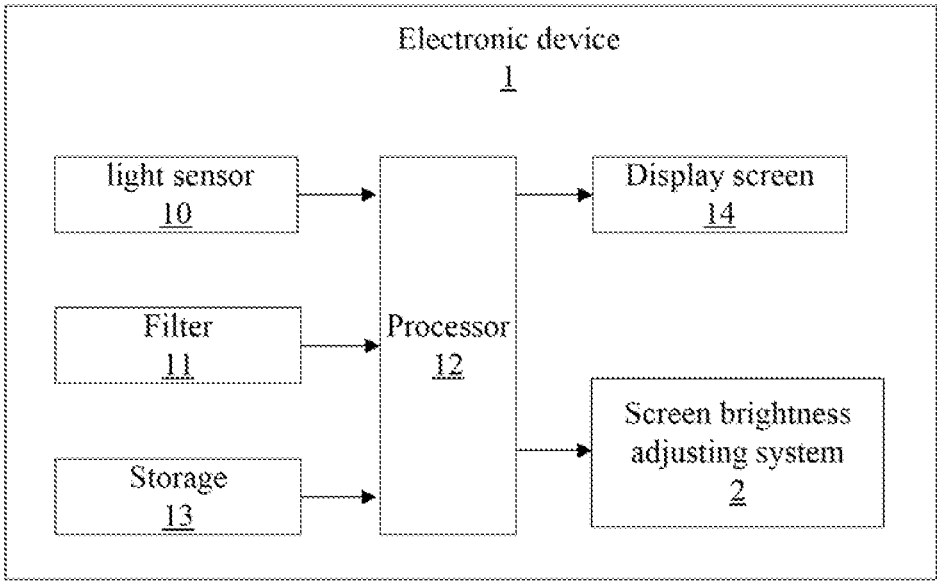
FIG. 1 is a block diagram of one embodiment of an electronic device.

It will be appreciated that for simplicity and clarity of illustration, where appropriate, reference numerals have been repeated among the different figures to indicate corresponding or analogous elements. In addition, numerous specific details are given in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The word "module," as used hereinafter, refers to logic embodied in hardware or firmware, or to a collection of software instructions, written in a programming language, such as, for example, Java, C, or assembly. One or more software instructions in the modules may be embedded in firmware. It will be appreciated that modules may comprise connected logic units, such as gates and flip-flops, and may comprise programmable units, such as programmable gate arrays or processors. The modules described herein may be implemented as either software and/or hardware modules and may be stored in any type of non-transitory computer-readable storage medium or other computer storage device. The term "comprising," when utilized, means "including, but not necessarily limited to"; it specifically indicates open-ended inclusion or membership in the so-described combination, group, series and the like.

FIG. 1 is a block diagram of one embodiment of an electronic device. The electronic device 1 may be, but is not limited to, a desktop computer, a notebook computer, and a handheld computing device, a cellular phone or a portable media player. The electronic device 1 can include a screen brightness adjusting system 2. In addition, the electronic device 1 further includes, but is not limited to, a light sensor 10, a filter 11, at least one processor 12, storage 13, and a display screen 14. FIG. 1 illustrates only one example of the electronic device 1, other examples can include more or fewer components than illustrated, or have a different configuration of the various components in other embodiments.

The screen brightness adjusting system 2 includes computerized codes that, when executed by the at least one processor 12, can automatically adjust brightness of the display screen 14 when ambient light conditions change according to user preferences. The computerized codes of the screen brightness adjusting system 2 can be stored in the storage 13.

The light sensor 10 is a mechanical or electronic device that detects ambient lights and acquires illumination values of the ambient lights.

The filter 11 can be used to denoise the illumination values of the ambient lights. The filter 11 can be a Kalman filter, also known as linear quadratic estimation (LQE), which is an algorithm that uses a series of measurements observed over time, containing noise and other inaccuracies, and produces estimates of unknown variables that tend to be more precise than those based on a single measurement alone.

The at least one processor 12 can be central processing unit (CPU), a microprocessor, or other data processor chip.

The storage 13 can include various types of non-transitory computer-readable storage mediums. For example, the storage device 11 can be an internal storage system, such as a flash memory, a random access memory (RAM) for temporary storage of information, and/or a read-only memory (ROM) for permanent storage of information. The storage 13 can also be an external storage system, such as a hard disk, a storage card, or a data storage medium.

In one embodiment, the storage 13 can store user data, such as a brightness/illumination relationship table. The brightness/illumination relationship table stores a relationship between brightness values of the display screen 14 and illumination values of the ambient lights. One example of the relationship between brightness values of the display screen 14 and illumination values of the ambient lights is shown below:

| Illumination values | 0 | 10 | 110 | 280 | 520 | 1200 | 3000 | 5000 | 8000 | 11500 | 15500 |
|---|---|---|---|---|---|---|---|---|---|---|---|
| brightness values | 0 | 10 | 20 | 30 | 40 | 70 | 100 | 120 | 190 | 210 | 240 |

The relationship between the brightness values and illumination values can be determined according to user preferences, or can be computed by self-learning the user preferences. In one embodiment, the manual adjustment by a user of the brightness value of the display screen 14 in a particular ambient light condition can be considered as a user preference.

The display screen 14 is a user interface. The display screen 14 can be illuminated by backlights emitted by the electronic device 1 for clear presentation of information visually. In another embodiment, the pixels of the display screen 14 are capable of emitting light and therefore the display screen 14 does not need backlights.

Figure 2:
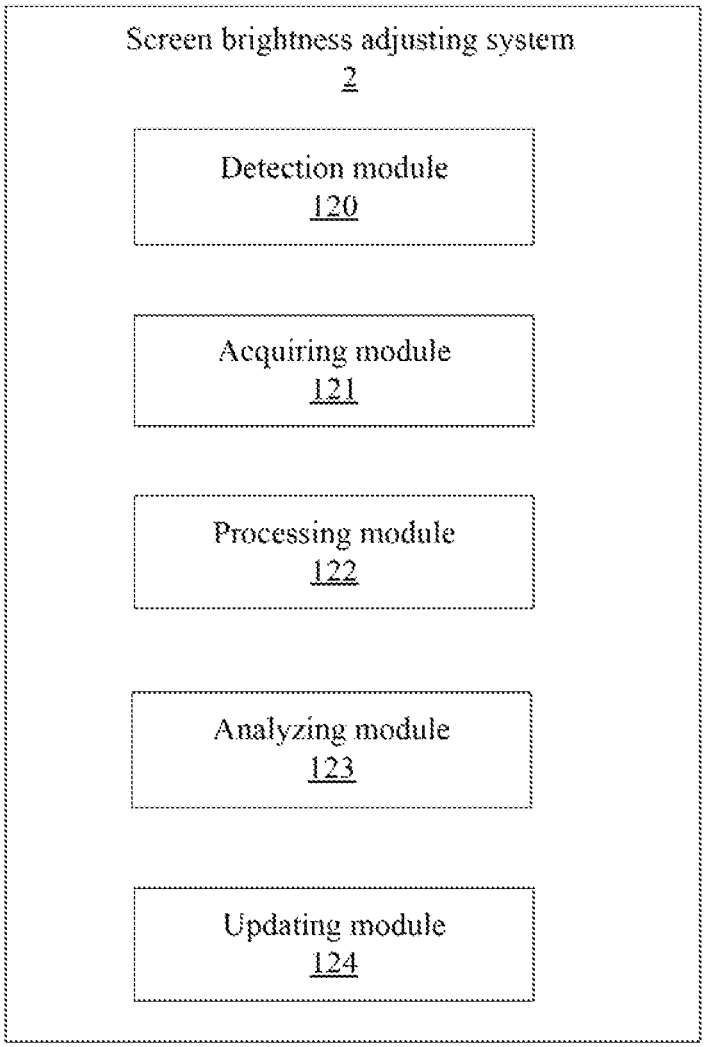
FIG. 2 is a block diagram of one embodiment of function modules of a screen brightness adjusting system.

FIG. 2 is a block diagram of one embodiment of function modules of the screen brightness adjusting system. In one embodiment, the function modules of the screen brightness adjusting system 2 can include a detection module 120, an acquiring module 121, a processing module 122, an analyzing module 123, and an updating module 124.

The detection module 130 can detect activation of the display screen 14 of the electronic device 1, and enable the light sensor 10 after detecting the display screen 14 is activated. In one embodiment, when a predetermined key is pressed, the detection module 13 can determine the display screen 14 is activated, then, the light sensor 10 is enabled to detect ambient lights and acquire a current illumination value of the ambient lights.

The acquiring module 121 can acquire a current brightness value of the display screen 14 and further acquire the current illumination value of the ambient lights. In one embodiment, the current brightness value and the current illumination value can constitute a feature value F=(l, b), where l is the current illumination value, and b is the current brightness value.

The processing module 122 can denoise the current illumination value, and normalize the current brightness value and the current illumination value. In one embodiment, the processing module 122 denoises the current illumination value for deleting shadow phenomenon in the ambient lights. In one embodiment, the processing module 122 normalizes the current brightness value and the current illumination value using the following formulas:

$$l_{norm} = \frac{\log_{10} l}{\log_{10} l_{max}};$$

$$b_{norm} = \frac{b}{b_{max}}.$$

Where $l_{max}$ and $b_{max}$ are preset constants, for example, $l_{max}$=15500 and $b_{max}$=255. After normalizing, the feature value is updated to be F=($l_{norm}$, $b_{norm}$).

The analyzing module 123 can adjust the current brightness value according to the current illumination value and the brightness/illumination relationship table stored in the storage 13. In one embodiment, the analyzing module 123 adjusts the current brightness value by self-learning the user preferences as follows.

The analyzing module 123 generates a node group which includes a plurality of nodes according to the brightness/illumination relationship table. The node group can be N=[$node_1$,Λ$node_i$,Λ$node_n$], where $node_i$=[$b_i$,$l_i$], i and n are integers, $l_{i+1}>l_i$, and $b_{i+1}>b_i$. For example, referring to the brightness/illumination relationship table above, $node_1$=[0, 0], $node_2$=[10, 10], $node_1$=[20, 110], Λ $node_n$=[240, 15500]. The updated feature value F=($l_{norm}$, $b_{norm}$) can be considered as a temporary node $node_c$=[$l_c$,$b_c$]. In one embodiment, the analyzing module 123 searches $node_i$ and $node_{i+1}$, where i≤c≤i+1. Furthermore, the analyzing module 123 computes a differential ΔD of an intersection point $node_x$ of $node_c$ and [$node_i$, $node_{i+1}$], where:

$$node_x = [l_x, b_x] = \left[l_c, b_i + \frac{b_{i+1} - b_i}{l_{i+1} + l_i}(l_c - l_i)\right]; \text{ and}$$

$$\Delta D = b_c - b_x = b_c - \left[b_i + \frac{b_{i+1} - b_i}{l_{i+1} + l_i}(l_c - l_i)\right].$$

The analyzing module 123 can adjust the temporary node to generate a new node $node_k$, where $node_k$=[$l_k$,$b_k$]=[$l_c$, ΔD·α·η+$b_c$], where α [0, 1], which is a learning rate, and $$\eta = \exp\left(-\frac{(l_c - l_n)^2}{2\sigma^2}\right),$$

which is a proximate function of the Normal distribution, where σ is a standard deviation. In one embodiment, the analyzing module further compares the new node $node_k$ with the node group N=[$node_1$,Λ $node_i$,Λ $node_n$], and further adjusts that $$b_k = \begin{cases} b_{k+1}, & b_k < b_{k-1} \\ b_k, & b_k \geq b_{k-1} \end{cases}$$

when $l_k>l_{k-1}$. In one embodiment, the analyzing module 123 can adjust the current brightness value of the display screen 14 to be $b_k$.

The updating module 124 can update the brightness/illumination relationship table by inserting the new node $node_k$. In other embodiments, the updating module 124 can also update the brightness/illumination relationship table according to manual adjustments of the brightness value of the display screen 14 in a particular ambient light condition.

Figure 3:
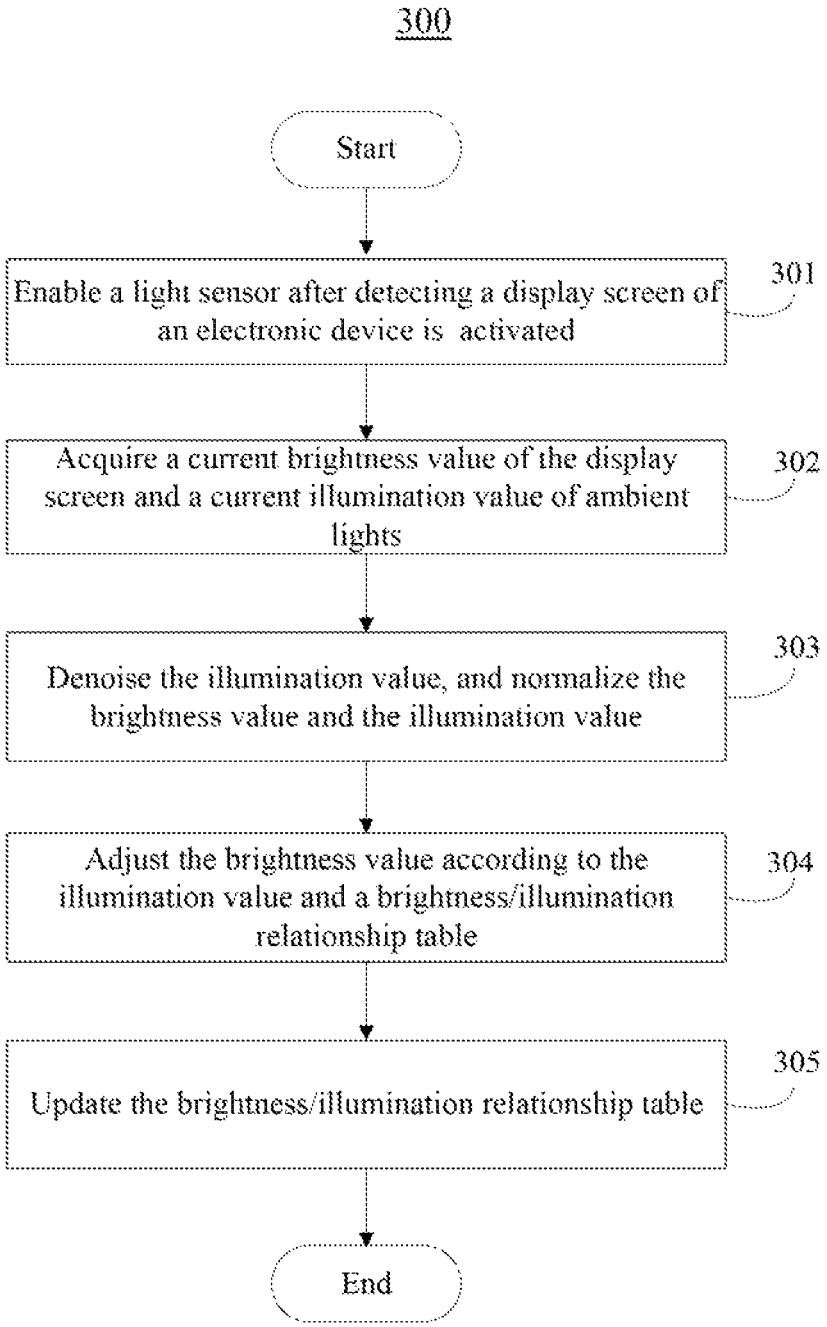
FIG. 3 is a flowchart of one embodiment of a method for adjusting brightness of a display screen of an electronic device.

FIG. 3 is a flowchart of one embodiment of a method for adjusting brightness of a display screen of an electronic device.

Referring to FIG. 3, a flowchart is presented in accordance with an example embodiment illustrated. The example method 300 is provided by way of example, as there are a variety of ways to carry out the method. The method 300 described below can be carried out using the configurations illustrated in FIGS. 1 and 2, for example, and various elements of these figures are referenced in explaining example method 300. Each block shown in FIG. 3 represents one or more processes, methods, or subroutines carried out in the exemplary method 300. Furthermore, the illustrated order of blocks is by example only and the order of the blocks can change. Additional blocks may be added or fewer blocks may be utilized, without departing from this disclosure. The exemplary method 300 can begin at block 301.

At block 301, a detection module enables a light sensor after detecting that a display screen of an electronic device is activated. In one embodiment, when detecting a predetermined key is pressed, the detection module can determine the display screen is activated, then, enable the light sensor to detect ambient lights and acquire a current illumination value of the ambient lights.

At block 302, an acquiring module acquires a current brightness value of the display screen and further acquires the current illumination value of the ambient lights. In one embodiment, the current brightness value and the current illumination value can constitute a feature value F=(l, b), where l is the current illumination value, and b is the current brightness value.

At block 303, a processing module denoises the current illumination value, and normalizes the current brightness value and the current illumination value. In one embodiment, the processing module denoises the current illumination value for deleting shadow phenomenon in the ambient lights. In one embodiment, the processing module normalizes the current brightness value and the current illumination value using the following formulas:

$$l_{norm} = \frac{\log_{10} l}{\log_{10} l_{max}};$$

$$b_{norm} = \frac{b}{b_{max}}.$$

Where $l_{max}$ and $b_{max}$ are preset constants, for example, $l_{max}$=15500 and $b_{max}$=255. After normalizing, the feature value can be updated to be F=($l_{norm}$, $b_{norm}$).

At block 304, an analyzing module adjusts the current brightness value according to the current illumination value and a brightness/illumination relationship table stored in a storage device. The brightness/illumination relationship table stores a relationship between brightness values of display screen and illumination values of the ambient lights. One example of the relationship between brightness values of the display screen and illumination values of the ambient lights is showed below:

| Illumination values | 0 | 10 | 110 | 280 | 520 | 1200 | 3000 | 5000 | 8000 | 11500 | 15500 |
|---|---|---|---|---|---|---|---|---|---|---|---|
| brightness values | 0 | 10 | 20 | 30 | 40 | 70 | 100 | 120 | 190 | 210 | 240 |

The relationship between the brightness values and illumination values can be determined according to user preferences, or can be computed by self-learning the user preferences. In one embodiment, the manual adjustment of the brightness value of the display screen in a particular ambient light condition can be considered as a user preference.

In one embodiment, the analyzing module 123 adjusts the current brightness value by self-learning the user preferences as follows.

The analyzing module generates a node group which includes a plurality of nodes according to the brightness/illumination relationship table. The node group can be N=[$node_1$,Λ$node_1$,Λ$node_n$], where $node_i$=[$b_i$,$l_i$], i and n are integers, $l_{i+1}>l_i$, and $b_{i+1}>b_i$. For example, referring to the brightness/illumination relationship table above, $node_1$=[0, 0], $node_2$=[10, 10], $node_1$=[20, 110], Λ $node_n$=[240, 15500].

The updated feature value F=($l_{norm}$, $b_{norm}$) can be considered as a temporary node $node_c$=[$l_c$,$b_c$]. In one embodiment, the analyzing module searches $node_i$ and $node_{i+1}$, where i≤c≤i+1. Furthermore, the analyzing module computes a differential ΔD of an intersection point $node_x$ of $node_c$ and [$node_i$, $node_{i+1}$], where:

$$node_x = [l_x, b_x] = \left[l_c, b_i + \frac{b_{i+1} - b_i}{l_{i+1} + l_i}(l_c - l_i)\right]; \text{ and}$$

$$\Delta D = b_c - b_x = b_c - \left[b_i + \frac{b_{i+1} - b_i}{l_{i+1} + l_i}(l_c - l_i)\right].$$

The analyzing module further adjusts the temporary node to generate a new node $node_k$, where $node_k$=[$l_k$,$b_k$]=[$l_c$, ΔD·α·η+$b_c$], wherein α [0, 1], which is a learning rate, and $$\eta = \exp\left(-\frac{(l_c - l_n)^2}{2\sigma^2}\right),$$

which is a proximate function of the Normal distribution, where σ is a standard deviation. In one embodiment, the analyzing module further compares the new node $node_k$ with the node group N=[$node_1$,Λ $node_i$,Λ $node_n$], and further adjusts that $$b_k = \begin{cases} b_{k+1}, & b_k < b_{k-1} \\ b_k, & b_k \geq b_{k-1} \end{cases}$$

when $l_k>l_{k-1}$. In one embodiment, the analyzing module adjusts the current brightness value of the display screen 14 to be $b_k$.

At block 305, an updating module 124 updates the brightness/illumination relationship table by inserting the new node $node_k$.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A method for adjusting brightness of a display screen of an electronic device, the method executable by at least one processor of the electronic device, the method comprising:

acquiring a current brightness value of the display screen and a current illumination value of ambient lights;

denoising the current illumination value to delete shadow phenomenon in the ambient lights; and adjusting the current brightness value of the display screen by self-learning user preferences according to the current illumination value and a brightness/illumination relationship table which stores a relationship between brightness values of the display screen and illumination values of ambient lights determined according to the user preferences, wherein the current brightness value is adjusted by:

generating a node group N including a plurality of nodes according to the brightness/illumination relationship table, where $N=[node_1,\Lambda node_i,\Lambda node_n]$, i and n are integers, $node_i=[b_i, l_i]$, $l_{i+1}>l_i$, and $b_{i+1}>b_i$, $l_i$ is a illumination value and b is a brightness value;

generating a temporary node $node_c=[l_c,b_c]$, where $l_c$ and $b_c$ are the current illumination value and the current brightness value;

searching $node_i$ and $node_{i+1}$ in the node group, where $i\leq c\leq i+1$;

computing a differential ΔD of an intersection point $node_x$ of $node_c$ and $[node_i, node_{i+1}]$;

adjusting the temporary node according to the differential ΔD to generate a new node $node_k$, wherein $node_k=[l_k,b_k]=[l_c,\Delta D\cdot\alpha\cdot\eta+b_c]$, α □[0, 1], α is a learning rate, and $\eta=\exp(-(l_c-l_n)^2/2\sigma^2)$, η is a proximate function of the Normal distribution, σ is a standard deviation; and adjusting the current brightness value of the display screen according to a comparison between the new node $node_k$ and the node group $N=[node_1, \ldots node_i, \ldots node_n]$.

2. The method according to claim 1, further comprising:

enabling a light sensor to acquire the current illumination value of the ambient lights after detecting the display screen is activated.

3. The method according to claim 1, further comprising:

normalizing the current illumination value by dividing a logarithm of the current illumination value by a logarithm of a first preset constant; and normalizing the current brightness value by dividing the current brightness value by a second preset constant.

4. The method according to claim 1, further comprising:

updating the brightness/illumination relationship table by inserting the new node $node_k$.

5. The method according to claim 1, further comprising:

updating the brightness/illumination relationship table according to user' manual adjustment of the brightness value of the display screen in a particular ambient light condition.

6. An electronic device for adjusting brightness of a display screen of the electronic device, comprising:

at least one processor; and a storage storing one or more programs which, when executed by the at least one processor, causes the at least one processor to:

acquire a current brightness value of the display screen and a current illumination value of ambient lights;

denoise the current illumination value to delete shadow phenomenon in the ambient lights; and adjust the current brightness value of the display screen by self-learning user preferences according to the current illumination value and a brightness/illumination relationship table which stores a relationship between brightness values of the display screen and illumination values of ambient lights determined according to the user preferences, when adjusting the current brightness value, the at least one processor:

generates a node group N including a plurality of nodes according to the brightness/illumination relationship table, where $N=[node_1,\Lambda node_i,\Lambda node_n]$, i and n are integers, $node_i=[b_i,l_i]$, $l_{i+1}>l_i$, and $b_{i+1}>b_i$, $l_i$ is a illumination value and b is a brightness value;

generates a temporary node $node_c=[l_c,b_c]$, where $l_c$ and $b_c$ are the current illumination value and the current brightness value;

searches $node_i$ and $node_{i+1}$ in the node group, where $i\leq c\leq i+1$;

computes a differential ΔD of an intersection point $node_x$ of $node_c$ and $[node_i, node_{i+1}]$;

adjusts the temporary node according to the differential ΔD to generate a new node $node_k$, wherein $node_k=[l_k,b_k]=[l_c,\Delta D\cdot\alpha\cdot\eta+b_c]$, α □[0, 1], α is a learning rate, and $\eta=\exp(-(l_c-l_n)^2/2\sigma^2)$, η is a proximate function of the Normal distribution, σ is a standard deviation; and adjusts the current brightness value of the display screen according to a comparison between the new node $node_k$ and the node group $N=[node_1, \ldots node_i, \ldots node_n]$.

7. The electronic device according to claim 6, wherein the at least one processor further:

enables a light sensor to acquire the current illumination value of the ambient lights after detecting the display screen is activated.

8. The electronic device according to claim 7, wherein the at least one processor further:

normalizes the current illumination value by dividing a logarithm of the current illumination value by a logarithm of a first preset constant; and normalizes the current brightness value by dividing the current brightness value by a second preset constant.

9. The electronic device according to claim 6, the at least one processor further:

updates the brightness/illumination relationship table by inserting the new node $node_k$.

10. The electronic device according to claim 6, the at least one processor further:

updates the brightness/illumination relationship table according to user' manual adjustment of the brightness value of the display screen in a particular ambient light condition.

11. A non-transitory storage medium having stored thereon instructions that, when executed by at least one processor of an electronic device, causes the at least one processor to perform a method for adjusting brightness of a display screen of the electronic device, the method comprising:

acquiring a current brightness value of the display screen and a current illumination value of ambient lights;

denoising the current illumination value to delete shadow phenomenon in the ambient lights; and adjusting the current brightness value of the display screen by self-learning user preferences according to the current illumination value and a brightness/illumination relationship table which stores a relationship between brightness values of the display screen and illumination values of ambient lights determined according to the user preferences, wherein the current brightness value is adjusted by:

generating a node group N including a plurality of nodes according to the brightness/illumination relationship table, where $N=[node_1,\Lambda node_i,\Lambda node_n]$, i and n are integers, $node_i=[b_i,l_i]$, $l_{i+1}>l_i$, and $b_{i+1}>b_i$, $l_i$ is a illumination value and b is a brightness value;

generating a temporary node $node_c=[l_c,b_c]$, where $l_c$ and $b_c$ are the current illumination value and the current brightness value;

searching $node_i$ and $node_{i+1}$ in the node group, where $i \le c \le i+1$;

computing a differential ΔD of an intersection point $node_x$ of $node_c$ and $[node_i, node_{i+1}]$;

adjusting the temporary node according to the differential ΔD to generate a new node $node_k$, wherein $node_k=[l_k,b_k]=[l_c,\Delta D\cdot\alpha\cdot\eta+b_c]$, α □[0, 1], α is a learning rate, and $\eta=\exp(-(l_c-l_n)^2/2\sigma^2)$, η is a proximate function of the Normal distribution, σ is a standard deviation; and adjusting the current brightness value of the display screen according to a comparison between the new node $node_k$ and the node group $N=[node_1, \ldots node_i, \ldots node_n]$.

12. The non-transitory storage medium according to claim 11, wherein the method further comprises:

enabling a light sensor to acquire the current illumination value of the ambient lights after detecting the display screen is activated.

13. The non-transitory storage medium according to claim 11, wherein the method further comprises:

normalizing the current illumination value by dividing a logarithm of the current illumination value by a logarithm of a first preset constant; and normalizing the current brightness value by dividing the current brightness value by a second preset constant.

14. The non-transitory storage medium according to claim 11, wherein the method further comprises:

updating the brightness/illumination relationship table by inserting the new node $node_k$.

15. The non-transitory storage medium according to claim 11, wherein the method further comprises:

updating the brightness/illumination relationship table according to user' manual adjustment of the brightness value of the display screen in a particular ambient light condition.

* * * * *